US010165877B2

(12) United States Patent
Sorensen et al.

(10) Patent No.: US 10,165,877 B2
(45) Date of Patent: Jan. 1, 2019

(54) STACKABLE CONTAINER SYSTEM

(71) Applicant: RUNWAY BLUE, LLC, Lehi, UT (US)

(72) Inventors: Steven M. Sorensen, Alpine, UT (US); Kim L. Sorensen, Alpine, UT (US); David O. Meyers, East Layton, UT (US)

(73) Assignee: Runway Blue, LLC, Alpine, UT (US)

( * ) Notice: Subject to any disclaimer, the term of this patent is extended or adjusted under 35 U.S.C. 154(b) by 0 days.

(21) Appl. No.: 15/149,095

(22) Filed: May 7, 2016

(65) Prior Publication Data

US 2016/0249755 A1 Sep. 1, 2016

Related U.S. Application Data

(63) Continuation of application No. 13/633,864, filed on Oct. 2, 2012, now Pat. No. 9,492,024.

(51) Int. Cl.
*B65D 21/00* (2006.01)
*A47G 19/22* (2006.01)
(Continued)

(52) U.S. Cl.
CPC ..... *A47G 19/2205* (2013.01); *A47G 19/2272* (2013.01); *A47G 19/23* (2013.01);
(Continued)

(58) Field of Classification Search
CPC ..... B65D 21/0228; B65D 21/0219; B65D 47/0895; B65D 51/242; B65D 51/28; B65D 51/02; B65D 81/3205
(Continued)

(56) References Cited

U.S. PATENT DOCUMENTS 1,037,051 A 8/1912 Ramsey
1,094,469 A 4/1914 Pick
(Continued)

FOREIGN PATENT DOCUMENTS

CN 201139196 10/2008
JP 09-40748 9/1997
(Continued)

OTHER PUBLICATIONS

Kor One, http://www.korwater.com/buyONE, accessed Apr. 21, 2010.

(Continued)

*Primary Examiner* — Ernesto Grano
(74) *Attorney, Agent, or Firm* — Maschoff Brennan

(57) ABSTRACT

The present invention is directed to a stackable container system. The stackable container system can comprise a beverage container, a beverage container lid, a plurality of smaller containers, and a plurality of smaller container lids. The smaller containers and smaller container lids are configured to allow any of the smaller container lids to be used on any of the smaller containers. The bottom of the beverage container and the bottom of each smaller container is also configured to allow the beverage container or smaller container to be interlocked with the top of any of the smaller container lids. In addition to storing beverage ingredients, the stackable container system can also be used to store other edible and inedible ingredients.

30 Claims, 3 Drawing Sheets

(51) Int. Cl.

| | |
|---|---|
| ***B65D 21/02*** | (2006.01) |
| ***B65D 81/32*** | (2006.01) |
| ***A47G 19/23*** | (2006.01) |
| ***B65D 25/04*** | (2006.01) |
| ***B65D 41/04*** | (2006.01) |
| ***B65D 47/06*** | (2006.01) |

(52) U.S. Cl.
CPC ..... *B65D 21/0228* (2013.01); *B65D 25/04* (2013.01); *B65D 41/04* (2013.01); *B65D 47/065* (2013.01); *B65D 81/3205* (2013.01); *F04C 2270/0421* (2013.01)

(58) Field of Classification Search
USPC ..... 215/329
See application file for complete search history.

(56) References Cited

U.S. PATENT DOCUMENTS 1,389,732 A 9/1921 Baron
1,479,053 A 1/1924 Brooks
1,573,620 A 2/1926 Allston
2,056,879 A 10/1936 Winterhalter et al.
2,272,867 A 2/1942 Cobel
2,514,573 A 7/1950 Harrison
2,573,378 A 10/1951 Zurlinden
2,574,876 A 11/1951 Lebus
2,575,299 A 11/1951 Scheel
2,638,253 A 5/1953 Mueller
2,748,997 A 6/1956 Richmond, Sr.
2,752,971 A 7/1956 Tupper
2,754,866 A 7/1956 Coltman
3,022,925 A 2/1962 Daniell
3,091,361 A 5/1963 Gawron
3,143,205 A 8/1964 Ruderian
3,144,016 A 8/1964 Basci
3,168,226 A 2/1965 Underwood
3,369,691 A * 2/1968 Wei ..... A47J 47/14 206/503
3,552,548 A 1/1971 Wallestad et al.
3,770,160 A 11/1973 Flider
3,820,692 A 6/1974 Swett et al.
D233,116 S 10/1974 Swett et al.
4,022,352 A 5/1977 Pehr
4,136,799 A 1/1979 Albert
4,158,902 A 6/1979 Chernack et al.
D261,088 S 10/1981 Akimov et al.
4,399,926 A 8/1983 Eidels-Dubovoy
4,457,458 A 7/1984 Heinol
4,474,303 A 10/1984 Maccise
4,519,518 A 5/1985 Wiles et al.
4,537,044 A 8/1985 Putnam
4,735,333 A 4/1988 Lay et al.
4,776,501 A 10/1988 Ostrowsky
4,805,790 A 2/1989 Leonetti et al.
4,932,225 A 6/1990 Bighouse
5,064,911 A 11/1991 Rohr et al.
5,065,877 A 11/1991 Karppinen et al.
5,088,614 A 2/1992 Dumestre
D330,862 S 11/1992 Shibley et al.
5,228,584 A 7/1993 Williams, Jr.
D342,898 S 1/1994 Baschmackoff
5,289,930 A 3/1994 Inouye
D350,460 S 9/1994 Picozza et al.
5,386,922 A 2/1995 Jordan
D356,499 S 3/1995 Cautereels et al.
5,547,111 A 8/1996 Geiger et al.
5,609,277 A 3/1997 McDonald
D382,968 S 8/1997 Giles et al.
D404,305 S 1/1999 De Baschmakoff
D405,654 S 2/1999 Moran
D421,547 S 3/2000 Demers
6,161,713 A 12/2000 Krich
6,283,333 B1 9/2001 Knickerbocker et al.
6,299,005 B1 10/2001 Higgins
6,379,032 B1 4/2002 Sorensen
D458,081 S 6/2002 Bodum
D461,420 S 8/2002 Kerman
D497,431 S 10/2004 Bentley
6,832,412 B2 12/2004 Kim
6,860,397 B1 3/2005 Walters, Jr.
D504,273 S 4/2005 Ancona
D508,185 S 8/2005 Gauss
D510,235 S * 10/2005 Sorensen ..... D7/510
D518,336 S 4/2006 Hirani
7,073,678 B1 7/2006 Dibdin et al.
D526,827 S 8/2006 Allen et al.
D528,862 S 9/2006 Li
D529,339 S 10/2006 Carreno et al.
D532,650 S 11/2006 de Groote
D543,454 S 5/2007 Leoncavallo et al.
D546,131 S 7/2007 Morales
D547,607 S 7/2007 Forsman
D565,353 S 4/2008 Roth et al.
D574,190 S 8/2008 Homma
D580,227 S 11/2008 Roth et al.
D586,184 S 2/2009 Miller et al.
D587,069 S 2/2009 Bodum
D589,751 S 4/2009 Liu et al.
D592,913 S 5/2009 Pinelli et al.
7,533,783 B2 5/2009 Choi et al.
D593,811 S 6/2009 Carreno
D599,664 S 9/2009 Fujinami et al.
D604,103 S 11/2009 Alviar et al.
D609,970 S 2/2010 Richau et al.
D613,110 S 4/2010 Lane et al.
D622,089 S 8/2010 Daniel et al.
D622,554 S 8/2010 Carreno
7,806,284 B2 10/2010 Mangano
D626,837 S 11/2010 Meyers et al.
D626,838 S 11/2010 Meyers et al.
D628,483 S 12/2010 McKinney et al.
D629,657 S 12/2010 Carreno
7,870,980 B2 1/2011 Wilson et al.
D641,594 S 7/2011 Huang
D644,065 S 8/2011 Llerena
8,020,257 B2 9/2011 Merten et al.
D646,546 S 10/2011 Robinson et al.
D646,919 S 10/2011 Nilsson
D647,760 S 11/2011 Pearson
D652,256 S 1/2012 Eyal
D655,131 S 3/2012 Nilsson
D655,967 S 3/2012 Bodum
D656,357 S 3/2012 Enghard
D661,551 S 6/2012 Gilbert
D666,047 S 8/2012 Lin
D666,061 S 8/2012 Ying
D667,694 S 9/2012 Meyers et al.
8,302,796 B1 11/2012 Johnson
8,342,349 B2 1/2013 Lu
D677,121 S 3/2013 Meyers et al.
D686,885 S 7/2013 Meyers et al.
D686,886 S 7/2013 Meyers et al.
D686,887 S 7/2013 Meyers et al.
D686,888 S 7/2013 Meyers et al.
9,216,843 B2 * 12/2015 Sorensen ..... B65D 21/02
2002/0074334 A1 6/2002 Karp
2003/0085228 A1 5/2003 Oakes
2004/0217139 A1 11/2004 Roth et al.
2004/0262306 A1 12/2004 Smith
2005/0045634 A1 3/2005 Ward et al.
2005/0045636 A1 3/2005 Lown et al.
2006/0213912 A1 9/2006 Zaytoun
2007/0012693 A1 1/2007 Kummer
2007/0175931 A1 8/2007 Leoncavallo et al.
2008/0099514 A1 5/2008 Carter et al.
2009/0018884 A1 1/2009 McConnell et al.
2009/0178940 A1 7/2009 Said
2009/0188884 A1 7/2009 Nelson et al.
2009/0188933 A1 7/2009 Daams
2009/0301990 A1 12/2009 Cresswell et al.
2010/0187235 A1 7/2010 Chen
2010/0200428 A1 8/2010 Davies

(56) References Cited

U.S. PATENT DOCUMENTS

| | | | |
|---|---|---|---|
| 2010/0206835 | A1 | 8/2010 | Yu |
| 2010/0224631 | A1 | 9/2010 | Roth et al. |
| 2010/0282703 | A1 | 11/2010 | Yang |
| 2011/0017760 | A1 | 1/2011 | Newman |
| 2011/0083300 | A1 | 4/2011 | Heger et al. |
| 2011/0253733 | A1 | 10/2011 | Meyers et al. |

FOREIGN PATENT DOCUMENTS

| | | | |
|---|---|---|---|
| JP | 2001 29976 | A | 10/2001 |
| JP | 2001-299876 | | 10/2001 |
| JP | 2006103793 | A | 4/2004 |
| JP | 2007-176581 | | 7/2007 |
| JP | 2008247404 | | 10/2008 |
| JP | 2009-029516 | | 2/2009 |
| KR | 20-0417757 | | 5/2006 |
| KR | 10-2010-0092252 | | 8/2010 |

OTHER PUBLICATIONS

Core 77, http://www.core77.com/blog/materials/kor.sub.--one.sub.--water.su-b.--vessel.sub.--actual.sub.--size.sub.--10211.asp, accessed Apr. 21, 2010.
Koyono, http://www.koyono.com/KOR-ONE-Green-Zen-Water-Hydration-Vessel.sub- .--p/kor-one.htm, accessed Apr. 21, 2010.
Fit Sugar, www.fitsugar.com/2496788, accessed Apr. 21, 2010.
Thermos, http://www.shopthermos.com/detail/TMS+HP4000GR6, accessed Apr. 21, 2010.
Goodlifter, http://www.goodlifer.com/2009/02/360-paper-water-bottle/, accessed Apr. 21, 2010.
Notice of Allowance from U.S. Appl. No. 29/430,882 dated Aug. 5, 2013.
Advisory Action from U.S. Appl. No. 12/762,292 dated May 24, 2013.
Office Action from U.S. Appl. No. 12/762,292 dated Jul. 1, 2013.
Office Action from U.S. Appl. No. 12/762,292 dated Oct. 2, 2012.
Office Action from U.S. Appl. No. 12/762,292 dated Jul. 17, 2012.
Office Action from U.S. Appl. No. 12/762,292 dated Feb. 10, 2012.
Notice of Allowance from U.S. Appl. No. 29/431,544 dated Aug. 14, 2013.
Office Action from U.S. Appl. No. 29/431,544 dated Mar. 25, 2013.
Office Action from U.S. Appl. No. 13/610,445 dated Mar. 29, 2013.
Office Action from U.S. Appl. No. 13/232,891 dated Jul. 19, 2013.
Office Action from U.S. Appl. No. 13/609,238 dated May 30, 2013.
International Search Report from PCT Application No. PCT/US2011/026508 dated Sep. 29, 2011.
Written Opinion from PCT Application No. PCT/US2011/026508 dated Sep. 29, 2011.
International Preliminary Report on Patentability from PCT Application No. PCT/US2011/026508 dated Oct. 16, 2012.
International Search Report from PCT Application No. PCT/US2012/054483 dated Nov. 16, 2012.
International Search Report and Written Opinion from PCT Application No. PCT/US2012/054497 dated Nov. 20, 2012.
International Search Report and Written Opinion from PCT Application No. PCT/US2013/052132 dated Aug. 16, 2013.
Office Action from U.S. Appl. No. 13/633,864 dated Mar. 29, 2013.
Office Action from U.S. Appl. No. 13/633,864 dated Oct. 18, 2013.
Office Action from U.S. Appl. No. 13/633,864 dated May 2, 2014.
Office Action from U.S. Appl. No. 13/633,864 dated Nov. 3, 2014.
Office Action from U.S. Appl. No. 13/633,864 dated Dec. 23, 2015.
Notice of Allowance from U.S. Appl. No. 13/633,864 dated Mar. 29, 2016.
International Preliminary Report on Patentability from PCT Application No. PCT/US2013/052132 dated Apr. 7, 2015.
International Search Report and Written Opinion from PCT Application No. PCT/US2013/047161 dated Nov. 20, 2013.
U.S. Appl. No. 12/762,292, filed Apr. 16, 2010, Meyers, et al.
U.S. Appl. No. 13/232,891, filed Sep. 14, 2011, Meyers, et al.
U.S. Appl. No. 13/232,935, filed Sep. 14, 2011, Meyers, et al.
U.S. Appl. No. 29/430,882, filed Aug. 30, 2012, Meyers, et al.
U.S. Appl. No. 29/431,544, filed Sep. 7, 2012, Meyers, et al.
U.S. Appl. No. 13/609,238, filed Sep. 10, 2012, Meyers, et al.
U.S. Appl. No. 13/610,445, filed Sep. 11, 2012, Meyers, et al.
U.S. Appl. No. 29/457,097, filed Jun. 6, 2013, Sorensen, et al.
U.S. Appl. No. 29/457,096, filed Jun. 6, 2013, Sorensen, et al.
U.S. Appl. No. 61/832,085, filed Jun. 6, 2013, Sorensen, et al.
Examination Report from EPO Patent Application No. 13 844 241.3, dated Dec. 9, 2016.
Office Action from Korean Patent Application No. 10-2015-7006591 dated Mar. 30, 2016 (with English translation).
Supplementary European Search Report from European Patent Application No. EP 13 84 8241 dated Jul. 15, 2015.

* cited by examiner

STACKABLE CONTAINER SYSTEM

CROSS-REFERENCE TO RELATED APPLICATIONS

The present application is a continuation of U.S. patent application Ser. No. 13/633,864 which was filed on Oct. 2, 2012, now U.S. Pat. No. 9,492,024, issued Nov. 15, 2016, and is hereby incorporated by reference in its entirety.

BACKGROUND OF THE INVENTION

Background

Beverage bottles or containers have become widely used. Such containers are often used to mix ingredients. For example, many people use these containers to mix nutritional powders into water or another liquid for consumption in conjunction with exercise.

It is often desirable to delay the mixing of the ingredients until an appropriate time. However, because such containers are often used on-the-go, it can be difficult to maintain the ingredients separate until the desired time. For example, some may use multiple containers to store the ingredients of a protein shake until after a workout is finished. Similarly, one or more separate containers may also be used to store supplements, such as vitamins or other pills, which are not mixed in the container.

Keeping track of multiple containers can be burdensome. To address this, some beverage containers have been developed that are configured to allow one or more additional containers to be attached to the beverage container. The additional containers can be used to store ingredients to be mixed in the beverage container at a later time, or to separately store other contents such as pills

BRIEF SUMMARY

The present invention is directed to a stackable container system. The stackable container system can be used to store ingredients for a beverage, or ingredients or substances for other edible or inedible mixes or purposes.

In one embodiment, a stackable container system of the present invention comprises a beverage container, a beverage container lid, a plurality of smaller containers, and a plurality of smaller container lids. The smaller containers and smaller container lids are configured to allow any of the smaller container lids to be used on any of the smaller containers. The bottom of the beverage container and the bottom of each smaller container is also configured to allow the beverage container or smaller container to be interlocked with the top of any of the smaller container lids.

In another embodiment, a stackable container system of the present invention comprises a beverage container, a beverage container lid, a plurality of smaller containers, a plurality of smaller container lids, and a divider that is sized to be inserted into at least one of the plurality of smaller containers when a smaller container lid is attached to the smaller container. The smaller containers and smaller container lids are configured to allow any of the smaller container lids to be used on any of the smaller containers. The bottom of the beverage container and the bottom of each smaller container is also configured to allow the beverage container or smaller container to be interlocked with the top of any of the smaller container lids.

In another embodiment, the stackable a container system of the present invention comprises a container, a container lid, a plurality of smaller containers, and a plurality of smaller container lids. The bottom of the container is configured to allow the container to be interlocked with the top of any of the at least one smaller container lid when the smaller container lid is secured to one of the at least one smaller container.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

The present invention is directed to a stackable container system. The stackable container system can be used to store ingredients for a beverage, or ingredients or substances for other edible or inedible mixes or purposes.

In one embodiment, a stackable container system of the present invention comprises a beverage container, a beverage container lid, a plurality of smaller containers, and a plurality of smaller container lids. The smaller containers and smaller container lids are configured to allow any of the smaller container lids to be used on any of the smaller containers. The bottom of the beverage container and the bottom of each smaller container is also configured to allow the beverage container or smaller container to be interlocked with the top of any of the smaller container lids.

In another embodiment, a stackable container system of the present invention comprises a beverage container, a beverage container lid, a plurality of smaller containers, a plurality of smaller container lids, and a divider that is sized to be inserted into at least one of the plurality of smaller containers when a smaller container lid is attached to the smaller container. The smaller containers and smaller container lids are configured to allow any of the smaller container lids to be used on any of the smaller containers. The bottom of the beverage container and the bottom of each smaller container is also configured to allow the beverage container or smaller container to be interlocked with the top of any of the smaller container lids.

In another embodiment, the stackable a container system of the present invention comprises a container, a container lid, a plurality of smaller containers, and a plurality of smaller container lids. The bottom of the container is configured to allow the container to be interlocked with the top of any of the at least one smaller container lid when the smaller container lid is secured to one of the at least one smaller container.

Figure 1:
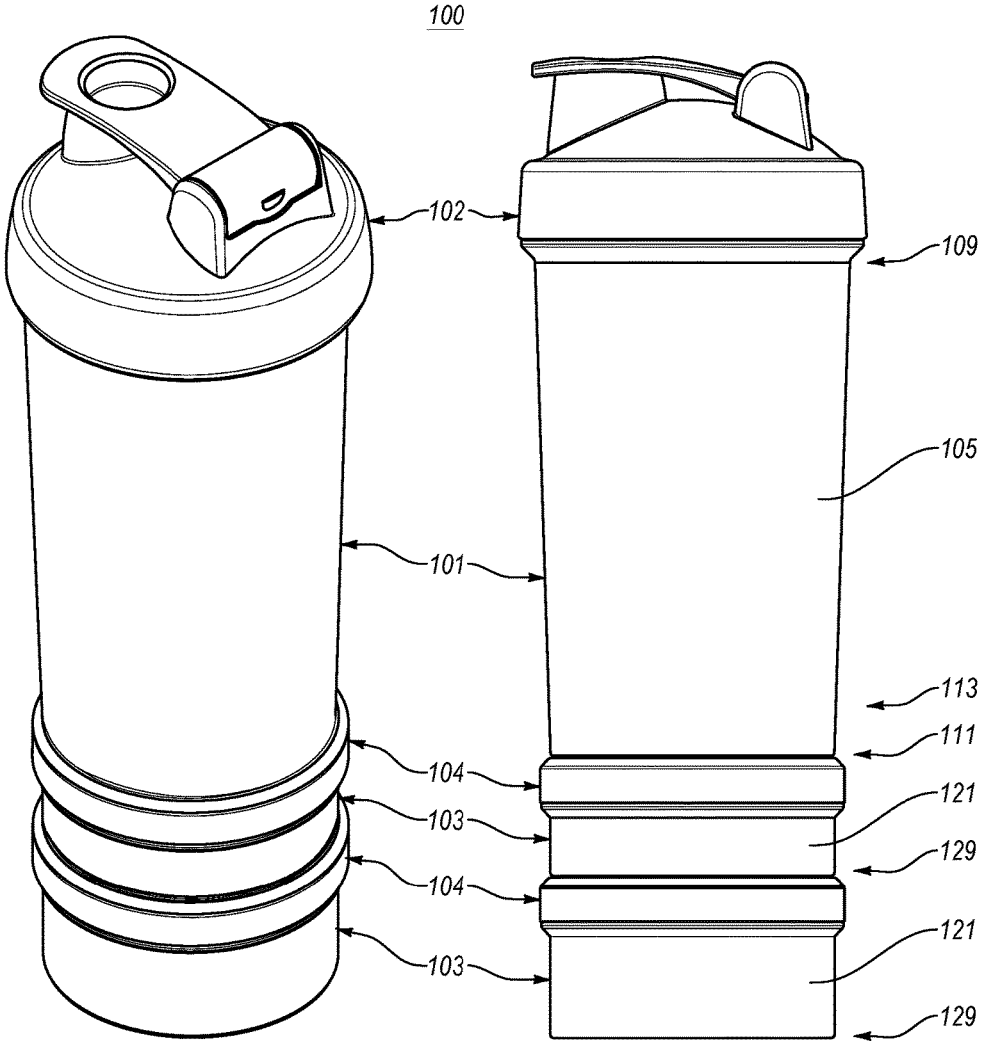
FIG. 1 illustrates two views of a stackable container system according to one or more embodiments of the invention.

FIG. 1 illustrates two views of a stackable container system 100 in accordance with one or more embodiments of the invention. As shown, stackable container system 100 includes a beverage container 101 with a beverage container lid 102, and two smaller containers 103 that each includes a lid 104.

Although stackable container system 100 is shown having two smaller containers with lids, in some embodiments, a stackable container system can have one or more smaller containers with lids that interconnect with beverage container 101. Further, the stackable container system of the present invention is not limited to any particular type of beverage container and beverage container lid such as those shown in FIG. 1. For example, a beverage container and beverage container lid in some embodiments of the stackable container system can be a baby bottle and nipple or another type of bottle and lid for containing and/or dispensing any type of beverage or pourable substance.

Figure 2:
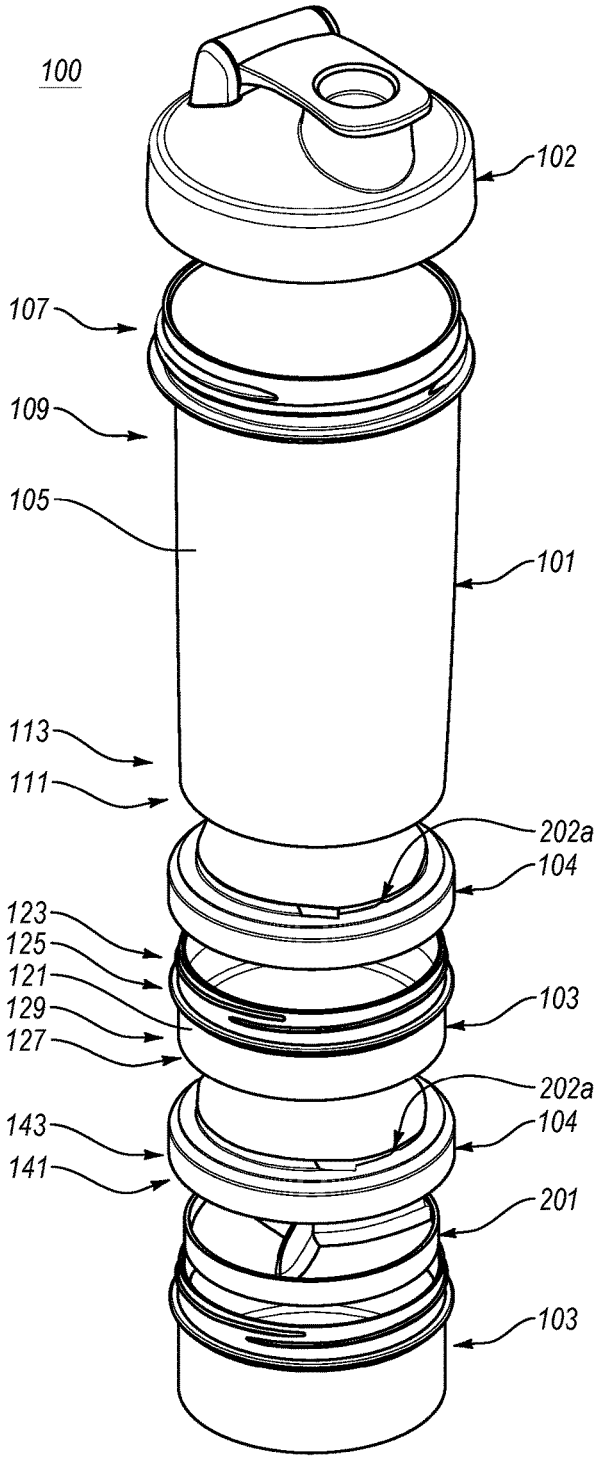
FIG. 2 illustrates an exploded view of the stackable container system of FIG. 1.

Each of lids 104 can be attached to either of smaller containers 103 (e.g. via threads (either on the inside or outside of smaller containers 103) as shown in FIG. 2 or other means as known in the art). The top of each of lids 104 is also configured to allow lid 104 to be attached to the bottom of beverage container 101 or either of smaller containers 103. In this manner, with lids 104 secured to smaller containers 103, smaller containers 103 and beverage container 101 can be interconnected to form a stack as shown in FIG. 1.

Because each container (beverage container 101 and smaller containers 103) includes a separate lid (beverage container lid 102 and lids 104), each container is independently sealable. In other words, stackable container system 100 comprises three containers that can each be sealed and used independently of the other containers, while still being interconnectable to form a single stackable container system.

FIG. 2 illustrates an exploded view of stackable container system 100. In addition to the components shown in FIG. 1, FIG. 2 also illustrates that stackable container system 100 can include a divider 201. Divider 201 can be configured to be inserted into one or more of smaller containers 103. The stackable container system of the present invention can include a single divider 201 (which may be inserted into one or more of the smaller containers), or more than one divider 201 (which may each be inserted into any of the smaller containers or which may each be configured to be inserted into a single specific smaller container).

Divider 201 is shown as having a base and three compartments. Accordingly, divider 201 provides three separate compartments for storing ingredients, pills, or other items as desired. Of course, a divider having fewer or more than three compartments could also be provided.

In some embodiments, each smaller container 103 that is configured to store divider 201 can include means for supporting divider 201. In some embodiments, this means can include a lip that extends around the inside wall of smaller container 103 on top of which divider 201 rests. One benefit of configuring smaller container 103 with a lip or other means for supporting divider 201 is that a space can be maintained within smaller container 103 and below divider 201 when divider 201 is inserted into smaller container 103. In other words, when a divider 201 providing three compartments is used, four separate compartments can be formed within smaller container 103 (one below divider 201 and three above (or within) divider 201).

Divider 201 can be configured to have a different depth than is shown in FIG. 2. In other words, the distance between the base and the top of divider 201 can be greater than or less than the distance shown in FIG. 2. Also, in some embodiments, divider 201 can be configured without a base in which case divider 201 can be placed in contact with the inside bottom surface of container 103 such that the inside bottom surface acts as a base for divider 201.

FIG. 2 also illustrates that lids 104 can be interconnected with the bottom of beverage container 101 or the bottom of a smaller container 103 using a bayonet mount. Although a bayonet mount is shown in FIG. 2, any type of connection can be used to secure lids 104 to the bottom of smaller containers 103 or beverage container 101 including by threading, snapping, twisting, sliding, or screwing lids 104 onto the bottom of the containers 101, 103.

Figure 3:
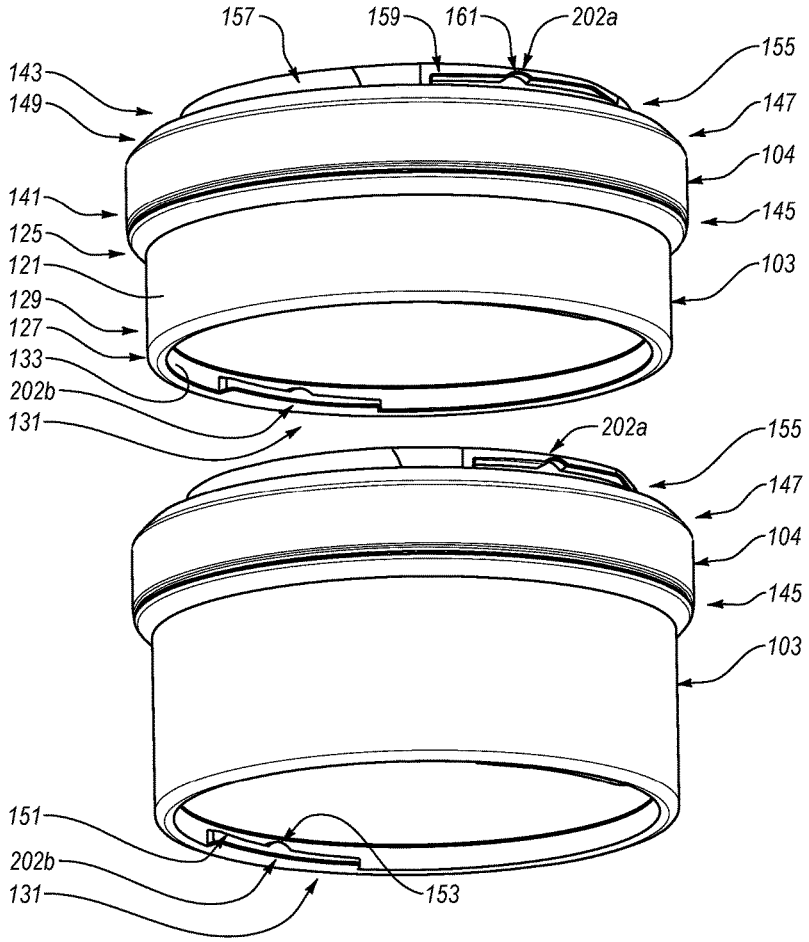
FIG. 3 illustrates an exploded view of two smaller containers with smaller container lids according to one or more embodiments of the invention.

In FIG. 2, a female side **202*a* of the bayonet mount is shown as being formed within the top surface of lids 104. As shown in FIG. 3, a corresponding male portion 202*b* of the bayonet mount can be formed within the bottom of smaller containers 103. A similar male portion can also be formed within the bottom of beverage container 101. Male portion 202*b* can be twisted into female portion 202*a*** to lock a lid to the bottom of a container.

In some embodiments, the female and male portions **202*a*, 202*b* of the bayonet mount can be universal thus allowing any lid 104 to be connected to the bottom of any of beverage container 101 and smaller containers 103. Further, the male and female portions could be equally formed on the top of lids 104 and the bottom of the containers respectively. However, one benefit of forming the male portion on the bottom of the containers is that it can allow a less rigid material to be used for lids 104**.

The stackable container system of the present invention can be used to store ingredients separately until the user desires to mix the ingredients. For example, a user can put ingredients for a protein shake in smaller containers 103 (with or without using divider 201). Once the user desires to mix the protein shake, he can remove smaller containers 103 to add their contents to beverage container 101, add liquid if necessary to beverage container 101, and mix the contents within beverage container 101.

In greater detail, as shown in FIGS. 1-3, the stackable container system 100 may include a beverage container 101. The beverage container 101 may include a body, such as a beverage container body 105, and a portion that is sized and configured to be connected to a lid, such as a beverage container lid connecting portion 107. The beverage container lid connecting portion 107 may be disposed at least proximate an upper portion 109 of the beverage container body 105. The beverage container 101 may also include an annular flange 111 and the flange may extend downwardly from a lower portion 113 of the beverage container body 105. In addition, the beverage container 101 may include a lid connecting portion disposed on an interior wall of the annular flange 111 of the beverage container body 105. As discussed above, the bottom of the beverage container 101 and the bottom of the smaller containers 103 may be configured to allow the beverage container 101 and the smaller containers 103 to be interlocked with the top of any of the smaller container lids 104. Thus, the lid connecting portion on the bottom of the beverage container 101 may be the same or similar to the lid connecting portion on the bottom of the smaller containers 103. The beverage container lid 102 may be selectively attached to the beverage container lid connecting portion 107. The system 100 may include one or more, such as a plurality, of smaller containers 103 and the smaller containers may be sized and configured to be interchangeably connected to the beverage container 101 and other smaller containers 103. The smaller containers 103 may include a smaller container body 121, a threaded connecting portion 123 disposed at least proximate an upper portion 125 of the smaller container body 121, an annular flange 127 extending downwardly from a lower portion 129 of the smaller container body 121, and a lid connecting portion 131 disposed on an interior wall 133 of the annular flange 127 of the smaller container body 121. The system 100 may include one or more, such as a plurality, of the smaller container lids 104 and the smaller container lids may be sized and configured to be selectively attached to the threaded connecting portion 123 of the smaller containers 103. The smaller container lids 104 may include a first connecting structure 141, such as an annular flange, that is sized and configured to be attached to the threaded connecting portion 123 of the smaller containers 103. The smaller container lids 104 may further include a second connecting structure 143, such as a container connecting portion, and the second connecting structure may be interchangeably connectable to the lid connecting portion 131 of the smaller container 103 (which may be referred to as smaller container lid connecting portion) and the lid connecting portion of the beverage container 101.

As shown in the accompanying figures, the stackable container system 100 may include the beverage container 101 and the beverage container may include the body 105, the beverage container lid connecting portion 107, which may be disposed at least proximate the upper portion 109 of the beverage container body 105, the annular flange 111 extending downwardly from the lower portion 113 of the beverage container body 105, and the lid connecting portion disposed on the interior portion of the annular flange 111 of the beverage container body 105. The beverage container lid 102 may be connected to the beverage container lid connecting portion 107 of the beverage container 101. As shown in FIG. 2, the beverage container lid 102 and the beverage container lid connecting portion 107 may be connected by a threaded connection. The one or more, or plurality, of the smaller containers 103 may be sized and configured to be interchangeably connected to the beverage container 101 and other smaller containers. Each smaller container 103 of the plurality of smaller containers may include the smaller container body 121, the threaded connecting portion 123 disposed at least proximate the upper portion 125 of the smaller container body 121, the annular flange 127 extending downwardly from the lower portion 129 of the smaller container body 121, and the lid connecting portion 131 disposed on the interior portion 133 of the annular flange 127 of the smaller container body 121. The system 100 may include a plurality of the smaller container lids 104 and the smaller container lids may be sized and configured to be selectively attached to the threaded connecting portion 123 of the smaller containers 103. The smaller container lids 104 may include the first connecting structure 141, which may be sized and configured to interchangeably connect the lid to one of the smaller containers 103, and a second connecting structure 143, which may be sized and configured to connect the smaller container lid 104 to one of the smaller containers 103 or the beverage container 101. The first connecting structure 141 may be disposed on a first side 145 of the lid 104 and the second connecting structure 143 disposed on a second side 147 of the lid 104, and a central portion 149, such as an annular ring or tapered portion, may be disposed between the first connecting structure on the first side of the lid and the second connecting structure on the second side of the lid. As shown in the accompanying figures, the central portion 149 may include a ring-shaped planar surface and the first connection structure 141 may extend downwardly relative to the ring-shaped planar surface and the second connecting structure may extend upwardly relative to the ring-shaped planar structure. Additionally, the first connecting structure 141 may be a different type of connecting structure than the second connecting structure 143.

As discussed above, FIGS. 1-3 show the stackable container system 100 may include a beverage container 101. The beverage container 101 may include the body 105, the annular flange 111 extending downwardly from the lower portion 113 of the body 105, and the lid connecting portion on the inner surface of the annular flange 111. The system 100 may also include a plurality of the smaller containers 103 and the smaller containers may be sized and configured to be interchangeably connected to the beverage container 101 and/or other smaller containers 103. The smaller containers 103 may include the body 121, the annular flange 127 extending downwardly from the lower portion 129 of the body 121, and the smaller container lid connecting portion 131 extending inwardly from the inner surface 133 of the annular flange 127 of the smaller container body 121. The system 100 may further include a plurality of the smaller container lids 104. The smaller container lids 104 may be sized and configured to interchangeably connect the smaller containers 103 and/or interchangeably connect the smaller containers 103 to the beverage container 101. The smaller container lid 104 may include the first connecting structure 141, which may be sized and configured to be connected to the upper portion 125 of the smaller container body 121. The smaller container lid 104 may include the second connecting structure 143, which may be sized and configured to be connected to the smaller container lid connecting portion 131 of the smaller containers 103 and the lid connecting portion of the beverage container 101. As shown in FIG. 3, for example, the smaller container lid connecting portion 131 may include a base 151 and an engaging member 153. The base 151 may extend inwardly from the inner surface 133 of the annular flange 127 and the base may include a planar lower surface that is generally aligned and disposed in the same plane as the lower surface of the annular flange. The base 151 may also form an inwardly extending portion or protrusion from the inner surface of 133 of the annular flange 127 of the smaller container body 121. An upper surface of the base 151 may be tapered or angled, and the engaging member 153 may be centrally disposed on the upper surface of the base. For example, as shown in FIG. 3, the engaging portion 153 may form a centrally disposed dome-shaped protrusion on the upper surface of the base 151. A receiving portion 155 of the second connecting structure 143 of the smaller container lid 104 may be sized and configured to receive at least a portion of the base 151 and the engaging member 153 when, for example, the smaller container lid 104 is connected to a smaller container 103. In addition, the lid connecting portion of the beverage container 101 and the lid connecting portion 131 of the smaller container 103 may be at least partially disposed in the receiving portion 155 of the second connecting structure 143 when the smaller container lid 104 is connected to the beverage container 101 or the smaller container 103. As shown in FIGS. 2 and 3, the receiving portion 155 of the second connecting structure 143 of the smaller container lid 104 may have the configuration of a slot, space, or opening. When the base 151 is at least partially disposed in the receiving portion 155 and the engaging member 153 is at least partially disposed in the receiving portion 161, the upper portion of the smaller container lid 104 may be connected to the lid connecting portion of the beverage container 101 or the smaller container lid connecting portion 131. This type of connection may be referred to as a bayonet-type connection.

As seen in FIGS. 2-3, the system 100 may include a plurality of the smaller container lids 104 that may be sized and configured to interchangeably connect the smaller containers 103 and/or interchangeably connect the smaller containers 103 to the beverage container 101. As previously discussed, the smaller container lid 104 may include the second connecting structure 143, such as upwardly extending connecting portion, that is sized and configured to be selectively connected to the lid connecting portion 131 of the smaller containers 103 and the lid connecting portion of the beverage container 101. In addition, as previously mentioned, the upwardly extending connecting portion of the second connecting structure 143 may form part of the female portion of the mount 202*a* and the smaller container lid connecting portion 131 may form part of the male portion of the mount 202*b*. In greater detail, for example, the upwardly extending connecting portion 143 may include an outer wall 157 and the female portion of the mount 202*a* may include a flange 159 that extends outwardly from the outer wall. A lower portion of the flange 159 may include the receiving portion 161, such as a recess, groove, or indentation. As shown in FIGS. 2 and 3, the receiving portion 161 may have a generally curved, arched, rounded, dome-shaped and/or semi-circular configuration and it may be generally centered along a length of the lower portion of the flange 159.

The male portion of the mount 202*b* is preferably complementary to the female portion of the mount 202*a*. For instance, as shown in the accompanying figures, the male portion of the mount 202*b* may include an inwardly extending flange 151 on the interior wall 133 of the annular flange 127. The inwardly extending flange 151 may include the engaging portion 153, such as a projection, protrusion, or protuberance. As shown in FIG. 3, the engaging portion 153 may have a generally curved, arched, rounded, dome-shaped and/or semi-circular configuration. As shown in the accompanying figures, the engaging portion 153 and receiving portion 161 may have generally complementary configurations. For example, both the engaging portion 153 and receiving portion 161 may have generally curved, arched, rounded, dome-shaped or semi-circular configurations. The engaging portion 153 may be at least partially disposed in the receiving portion 161 when the smaller container lid 104 is connected to the smaller container 103 or the beverage container 101. The engaging portion 153 on the inwardly extending flange 151 of the male portion of the mount 202*b* is preferably sized and configured to be at least partially disposed in the receiving portion 161 of the outwardly extending flange 159 of the female portion of the mount 202*a*, when the lid 104 is connected to the smaller container 103 or the beverage container 101. In greater detail, the male portion of the mount 202*b* may be at least partially disposed in the female portion of the mount 202*a*, and the female portion of the mount 202*a* and/or the male portion of the mount 202*b* may be rotated or moved so that the engaging portion 153 on the inwardly extending flange 151 of the male portion of the mount is at least partially disposed in the receiving portion 161 of the outwardly extending flange 159 of the female portion of the mount. Advantageously, this may allow the smaller container lid 104 to be securely and selectively attached to the beverage container 101 or a smaller container 103. In addition, when the engaging portion 153 on the inwardly extending flange 151 of the male portion of the mount 202*b* is at least partially disposed in the receiving portion 161 of the outwardly extending flange 159 of the female portion of the mount 202*a*, the outwardly extending flange of the female portion of the mount may at least partially abut the inwardly extending flange of the male portion of the mount.

As illustrated in FIGS. 2 and 3, for example, the stackable container system 100 may include a beverage container 101, a beverage container lid 102, a plurality of smaller containers 103, and a plurality of smaller container lids 104. In greater detail, the beverage container 101 may include the beverage container body 105; the beverage container lid connecting portion 107 disposed at least proximate the upper portion 109 of the beverage container body 105; the annular flange 111 extending downwardly from the lower portion 113 of the beverage container body 105; and the lid connecting portion disposed on the interior wall of the annular flange 111 of the beverage container body 105. The beverage container lid 102 may be selectively attached to the beverage container lid connecting portion 107. The plurality of smaller containers 103 may be sized and configured to be interchangeably connected to the beverage container 101 and other smaller containers 103. Each of the smaller containers 103 of the plurality of smaller containers may include the smaller container body 121; the threaded connecting portion 123 disposed at least proximate the upper portion 125 of the smaller container body 121; the annular flange 127 extending downwardly from the lower portion 129 of the smaller container body 121; and the lid connecting portion 131 disposed on the interior wall 133 of the annular flange 127 of the smaller container body 121. The plurality of smaller container lids 104 may be sized and configured to be selectively attached to the threaded connecting portion 123 of the smaller containers 103. Each of the smaller container lids 104 of the plurality of smaller container lids may include the annular flange 127 sized and configured to be attached to the threaded connecting portion 123 of the smaller containers 103; and the container connecting portion 143 that is interchangeably connectable to the lid connecting portion 131 of the smaller container 103 and the lid connecting portion of the beverage container 101. Additionally, the container connecting portion 143 of the smaller container lids 104 may include an outwardly extending flange 159 and a receiving portion 161 disposed in the outwardly extending flange, which may be part of the female portion of the mount 202*a*. The lid connecting portion of the beverage container 101 and the lid connecting portion of the smaller containers 103 may include an inwardly extending flange 151 and an engaging portion 153, which may be part of the male portion of the mount 202*b*. In addition, the outwardly extending flange 159 of the container connecting portion 143 of the smaller container lids 104 may at least partially abut the inwardly extending flange 151 of the lid connecting portion 131. Further, the engaging portion 153 of the lid connecting portion of the beverage container 101 and the lid connecting portion 131 of the smaller containers 103 may be at least partially disposed in the receiving portion 155 of the container connecting portion of the smaller container lids 104. Advantageously, this may allow the beverage container 101, the smaller containers 103 and the smaller container lids 104 to be selectively connected in various combinations and arrangements.

The stackable container system can also be used to store ingredients for and later mix the ingredients for any type of beverage or pourable substance such as, for example, baby formula, ingredients for salad dressing, ingredients for pancake batter, nutritional drink mixes, ingredients for inedible substances (e.g. paints), etc. Accordingly, the stackable container system should not be limited to any particular use (including to uses for mixing edible substances), but should extend to a stackable container system for storing and/or mixing ingredients whether the ingredients are for a beverage or other edible mix or for an inedible mix.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A stackable container system comprising:

a beverage container comprising:

a beverage container body;

a beverage container lid connecting portion disposed at least proximate an upper portion of the beverage container body, the beverage container lid connecting portion comprising a threaded connecting portion disposed on an outer surface of the upper portion of the beverage container body;

an annular flange extending downwardly from a lower portion of the beverage container body; and a smaller container lid connecting portion disposed on an interior wall of the annular flange, the smaller container lid connecting portion comprising a male portion of a bayonet mount including an inwardly extending flange from the annular flange and an engaging portion;

a beverage container lid selectively connected to the beverage container lid connecting portion of the beverage container, the beverage container lid comprising an opening and a closure, the closure sized and configured to selectively close the opening in the lid, the beverage container lid including a threaded connecting portion disposed on an inner surface of an annular wall;

at least one smaller container sized and configured to be selectively connected to the beverage container, each smaller container comprising:

a smaller container body; and a threaded connecting portion disposed at least proximate an upper portion of the smaller container body, the threaded connecting portion disposed on an outer surface of the upper portion of the smaller container body; and at least one smaller container lid sized and configured to be selectively connected to the threaded connecting portion of the smaller container and the smaller container lid connecting portion of the beverage container, each smaller container lid comprising:

a first connecting structure on a first side of the smaller container lid, the first connecting structure comprising a threaded connecting portion on an inner surface of a downwardly extending flange that is selectively connected to the threaded connecting portion of the smaller container;

a second connecting structure on a second side of the smaller container lid, the second connecting structure comprising a female portion of a bayonet mount, the female portion of the bayonet mount comprising:

an upwardly extending portion having a perimeter located horizontally inward of a perimeter of the downwardly extending flange of the first connecting structure on the first side of the smaller container lid;

at least one outwardly extending flange disposed on an outer wall of the upwardly extending portion, an upper surface of the outwardly extending flange generally aligned with an upper surface of the upwardly extending portion of the second connecting structure; and an upwardly extending receiving portion disposed in a lower portion of the outwardly extending flange, the upwardly extending receiving portion sized and configured to receive the engaging portion of the smaller container lid connecting portion when the smaller container lid is connected to the smaller container lid connecting portion of the beverage container; and a central portion disposed between and separating the first connecting structure and the second connecting structure of the smaller container lid, the first connecting structure and the second connecting structure comprising different types of connecting structures;

wherein the outwardly extending flange of the second connecting structure of the smaller container lid at least partially abuts the inwardly extending flange of the smaller container lid connecting portion of the beverage container when the smaller container lid is connected to the beverage container;

wherein the second connecting structure of the smaller container lid is at least partially disposed in the smaller container lid connecting portion of the beverage container when the smaller container lid is connected to the beverage container; and wherein the threaded connecting portion of the smaller container is at least partially disposed in the first connecting structure of the smaller container lid when the smaller container is connected to the smaller container lid.

2. The stackable container system as in claim 1, wherein the threaded connecting portion of the beverage container lid connecting portion of the beverage container has a larger diameter than the threaded connecting portion of the smaller container.

3. The stackable container system as in claim 1, wherein a diameter of the lower portion of the beverage container body and a diameter of the smaller container body are at least generally equal.

4. The stackable container system as in claim 1, wherein the beverage container body has a tapered configuration with a larger upper diameter and a smaller lower diameter, the lower diameter of the beverage container body at least generally equal to a diameter of the smaller container body.

5. The stackable container system as in claim 1, wherein the bayonet mount allows the smaller container lid to be selectively attached to the beverage container;

wherein the beverage container lid is selectively connected to the beverage container by a first threaded connection;

wherein the smaller container lid is selectively connected to the smaller container by a second threaded connection;

wherein the first threaded connection and the second threaded connection are not compatible.

6. The stackable container system as in claim 1, wherein the first connecting structure on the first side of the smaller container lid has an inner diameter that is larger than an outer diameter of the second connecting structure on the second side of the smaller container lid.

7. The stackable container system as in claim 1, further comprising a wall disposed at an end of the outwardly extending flange of the second connecting structure of the smaller container lid, the wall outwardly extending from the outer wall of the upwardly extending portion of the second connecting structure of the smaller container lid.

8. The stackable container system as in claim 1, further comprising a divider selectively connected to a lower surface of the smaller container lid.

9. The stackable container system as in claim 1, further comprising an annular flange extending downwardly from a lower portion of the smaller container body of the smaller container; and a smaller container lid connecting portion disposed on an interior wall of the annular flange extending downwardly from the smaller container body, the smaller container lid connecting portion comprising a male portion of a bayonet mount including an inwardly extending flange from the annular flange and an engaging portion.

10. The stackable container system as in claim 1, wherein a smaller container lid can be interchangeably connected to a smaller container and the smaller container lid connecting portion of the beverage container.

11. A stackable container system comprising:

a beverage container comprising:

a beverage container body;

a threaded connecting portion disposed at least proximate an upper portion of the beverage container body;

an annular flange extending downwardly from a lower portion of the beverage container body; and a smaller container lid connecting portion disposed on an interior portion of the annular flange of the beverage container body, the smaller container lid connecting portion comprising a male portion of a bayonet mount including an inwardly extending flange and an engaging portion;

a beverage container lid selectively attached to the threaded connecting portion of the beverage container, the beverage container lid comprising an opening in an upper portion of the lid and a closure, the closure sized and configured to selectively close the opening in the lid;

one or more smaller containers sized and configured to be selectively connected to the beverage container, each smaller container of the one or more smaller containers comprising:

a smaller container body; and a threaded connecting portion disposed at least proximate an upper portion of the smaller container body;

one or more smaller container lids sized and configured to be selectively attached to the threaded connecting portion of the smaller containers, each smaller container lid of the one or more smaller container lids comprising:

a first connecting structure on a first side of the smaller container lid, the first connecting structure comprising a threaded connecting portion sized and configured to selectively connect the smaller container lid to the smaller container;

a second connecting structure on a second side of the smaller container lid, the second side of the smaller container lid located above the first side of the smaller container lid, the second connecting structure comprising a female portion of a bayonet mount sized and configured to connect the smaller container lid to the beverage container, the first connecting structure being a different type of connecting structure than the second connecting structure, the first connecting structure being disposed lower than the second connecting structure, the second connecting structure comprising:

an upwardly extending portion;

at least one outwardly extending flange disposed on an outer wall of the upwardly extending portion; and an upwardly extending receiving portion disposed in a lower portion of the outwardly extending flange; and a ring-shaped central portion disposed between the first connecting structure and the second connecting structure;

wherein the engaging portion of the smaller container lid connecting portion is complementary to the receiving portion in the lower portion of the outwardly extending flange of the second connecting structure of the smaller container lid;

wherein the outwardly extending flange of the second connecting structure of the smaller container lid at least partially abuts the inwardly extending flange of the smaller container lid connecting portion of the beverage container when the smaller container lid is connected to the beverage container;

wherein the second connecting structure of the smaller container lid is at least partially disposed in the smaller container lid connecting portion of the beverage container when the smaller container lid is connected to the beverage container; and wherein the threaded connecting portion of the smaller container is at least partially disposed in the first connecting structure of the smaller container lid when the smaller container is connected to the smaller container lid.

12. The stackable container system as in claim 11, wherein the ring-shaped central portion of the smaller container lid vertically separates the first connecting structure and the second connecting structure, the first connecting structure comprising a downwardly extending annular flange with the threaded connecting portion disposed on an inner surface of the annual flange.

13. The stackable container system as in claim 12, wherein an outer diameter of the second connecting structure is smaller than an inner diameter of the first connecting structure.

14. The stackable container system as in claim 12, wherein an outer diameter of the second connecting structure is smaller than an outer diameter of the first connecting structure.

15. The stackable container system as in claim 12, wherein the annular flange of the first connecting structure is generally perpendicularly disposed to an upper surface of the ring-shaped central portion of the smaller container lid and the upwardly extending portion of the second connecting structure is generally perpendicularly disposed to the upper surface of the ring-shaped central portion of the smaller container lid.

16. The stackable container system as in claim 11, wherein the bayonet mount allows the smaller container lid to be selectively attached to the beverage container;

wherein the beverage container lid is selectively connected to the beverage container by a first threaded connection;

wherein the smaller container lid is selectively connected to the smaller container by a second threaded connection;

wherein the first threaded connection and the second threaded connection are not compatible.

17. The stackable container system as in claim 11, further comprising a wall disposed at an end of the outwardly extending flange of the second connecting structure of the smaller container lid, the wall outwardly extending from the outer wall of the upwardly extending portion of the second connecting structure.

18. The stackable container system as in claim 11, wherein the lower portion of the beverage container and the one or more small container lids have substantially the same outer diameter.

19. The stackable container system as in claim 11, further comprising a divider selectively connected to the smaller container lid.

20. The stackable container as in claim 11, wherein the beverage container body has a tapered configuration with a larger upper diameter and a smaller lower diameter, the lower diameter of the beverage container body at least generally equal to a diameter of the smaller container body.

21. A system comprising:

a beverage container lid comprising:

an opening;

a closure pivotably coupled to the lid, the closure capable of moving between an open position and a closed position; and a downwardly extending wall, at least one thread of a threaded connector disposed on an inner surface of the downwardly extending wall;

a beverage container comprising:

an upper portion including at least one thread of a threaded connector disposed on an outer surface of the upper portion of the beverage container, the threaded connector of the upper portion of the beverage container sized and configured to be connected to the threaded connector of the beverage container lid; and a lower portion including a downwardly extending wall, at least one internal bayonet mount portion disposed on an inner surface of the downwardly extending wall, the internal bayonet mount portion including an inwardly extending flange and an engaging portion disposed on the inner surface of the downwardly extending wall;

a smaller container lid comprising:

an upper portion including at least one external bayonet mount portion sized and configured to be connected to the internal bayonet mount portion of the beverage container, the external bayonet mount portion including an outwardly extending flange with an upper surface generally aligned with an upper surface of the upper portion of the smaller container lid; and a lower portion including a downwardly extending wall, at least one thread of a threaded connector disposed on an inner surface of the downwardly extending wall, the lower portion of the smaller container lid vertically disposed lower than the upper portion of the smaller container lid, and a perimeter of the lower portion of the smaller container lid being located horizontally outside a perimeter of the upper portion of the smaller container lid; and a smaller container comprising:

a body; and an upper portion of the body including at least one thread of a threaded connector disposed on an outer surface of the upper portion of the smaller container, the threaded connector of the upper portion of the smaller container sized and configured to be connected to the threaded connector of the smaller container lid.

22. The system of claim 21, wherein the threaded connector of the beverage container lid is not compatible with the threaded connector of the upper portion of the smaller container; and wherein the threaded connector of the lower portion of the smaller container lid is not compatible with the threaded connector of the upper portion of the beverage container.

23. The system of claim 21, wherein the lower internal bayonet mount portion of the beverage container comprises a male portion of a bayonet mount;

wherein the external bayonet mount portion of the smaller container lid comprises a female portion of the bayonet mount; and wherein an upper portion of the engaging portion of the male portion of the bayonet mount is disposed in a receiving portion in a lower surface of the outwardly extending flange of the female portion of the bayonet mount when the smaller container lid is connected to the beverage container.

24. The system of claim 21, wherein the external bayonet mount portion of the smaller container lid further comprises a receiving portion generally centrally disposed in a lower surface of the outwardly extending flange.

25. The system of claim 21, wherein the external bayonet mount portion of the smaller container lid further comprises a receiving portion generally centrally disposed in a lower surface of the outwardly extending flange, the receiving portion upwardly extending from the lower surface of the outwardly extending flange.

26. The system of claim 21, further comprising an end wall disposed at least proximate an end of the outwardly extending flange of the upper portion of the smaller container lid, the end wall and the flange extending outwardly from an outer surface of a circular wall of the upper portion of the smaller container lid.

27. The system of claim 21, wherein the outwardly extending flange of the upper portion of the smaller container lid has a thickness that increases along a length of the flange.

28. The system of claim 21, wherein the outwardly extending flange of the external bayonet mount portion of the smaller container lid and the upper surface of the upper portion of the smaller container lid are generally coplanar.

29. The system of claim 21, wherein an upper portion of the engaging portion of the internal portion of the bayonet mount is sized and configured to be disposed in the receiving portion of the external bayonet mount portion of the smaller container lid when the smaller container lid and the beverage container are connected;

wherein an upper surface of the engaging portion is disposed a larger distance from a bottom surface of the beverage container than an upper surface of the inwardly extending flange; and wherein an upper surface of the engaging portion not aligned with an upper surface of the inwardly extending flange.

30. The system of claim 21, wherein the lower portion of the smaller container includes a downwardly extending wall, at least one internal bayonet mount portion disposed on an inner surface of the downwardly extending wall, the internal bayonet mount portion including an inwardly extending flange and an engaging portion disposed on the inner surface of the downwardly extending wall.

* * * * *